US010294621B1

(12) United States Patent
Chen et al.

(10) Patent No.: US 10,294,621 B1
(45) Date of Patent: May 21, 2019

(54) DEVICE FOR SOFT SOIL FOUNDATION TREATMENT BY MEANS OF VACUUM-MEMBRANE-FREE VACUUM PRELOADING AND TREATMENT METHOD

(71) Applicant: PowerChina Huadong Engineering Corporation Limited, Hangzhou, Zhejiang (CN)

(72) Inventors: Wenhua Chen, Zhejiang (CN); Guanye Wu, Zhejiang (CN); Jing Hou, Zhejiang (CN)

(73) Assignee: PowerChina Huadong Engineering Corporation Limited, Hangzhou (CN)

( * ) Notice: Subject to any disclaimer, the term of this patent is extended or adjusted under 35 U.S.C. 154(b) by 0 days.

(21) Appl. No.: 16/028,350

(22) Filed: Jul. 5, 2018

(30) Foreign Application Priority Data

Nov. 17, 2017 (CN) ..... 2017 1 1144994

(51) Int. Cl.
*E02D 3/10* (2006.01)

(52) U.S. Cl.
CPC ..... *E02D 3/10* (2013.01)

(58) Field of Classification Search
CPC ..... B09C 1/005; E02D 3/10; E02D 23/14; E02B 2017/0082
See application file for complete search history.

(56) References Cited

U.S. PATENT DOCUMENTS 4,733,993 A * 3/1988 Andreasson ..... B63B 21/26 114/296
4,842,448 A * 6/1989 Koerner ..... B09C 1/06 405/128.35
5,697,437 A * 12/1997 Weidner ..... B09C 1/005 166/268
2007/0127988 A1* 6/2007 Nakakuma ..... E02D 3/10 405/36
2007/0231082 A1* 10/2007 Moon ..... E02D 3/10 405/258.1
2009/0297276 A1* 12/2009 Foo ..... B63B 21/27 405/224
2012/0230773 A1* 9/2012 Foo ..... E02B 17/021 405/224

FOREIGN PATENT DOCUMENTS

JP 2001226951 * 8/2001

* cited by examiner

*Primary Examiner* — Carib A Oquendo
(74) *Attorney, Agent, or Firm* — Wayne & Ken, LLC; Tony Hom

(57) ABSTRACT

The invention relates to a device for soft soil foundation treatment by vacuum-membrane-free vacuum preloading and a treatment method. The device comprises includes several top plates for being laid on the surface of soft soil foundation and several vertical plates for being vertically driven into the soft soil foundation, wherein the vertical plates are driven against the symmetrical side edges of the top plates; the vertical plate has an inner chamber, the top surface of the vertical plate is provided with a vertical plate main-hole in communication with the inner chamber of the vertical plate, both sides of the vertical plate are provided with several vertical plate vacuum mini-holes in communication with the inner chamber of the vertical plate; the vertical plate main-hole is in communication with vacuum equipment. The invention is applicable to applicable to the field of geotechnical engineering techniques.

10 Claims, 4 Drawing Sheets

DEVICE FOR SOFT SOIL FOUNDATION TREATMENT BY MEANS OF VACUUM-MEMBRANE-FREE VACUUM PRELOADING AND TREATMENT METHOD

FIELD OF THE INVENTION

The present invention relates to a device for soft soil foundation treatment by means of vacuum-membrane-free vacuum preloading and a treatment method, which are applicable to the field of geotechnical engineering techniques.

BACKGROUND OF THE INVENTION

Vacuum or vacuum combined surcharge preloading drainage consolidation method has been widely used in soft soil foundation treatment, and this technology has been developed from the earlier vertical and horizontal drainage channels formed by "plastic drainage strip+sand cushion+vacuum tube+geomembrane" to the current vacuum closed system formed by "plastic drainage strip+plate head connector+secondary vacuum tube+main vacuum tube+geomembrane or silt covered sealing layer".

However, in practice, it is difficult to control the quality and effect thereof, as it is difficult to control the depth of the drainage strip and it is difficult to measure the distribution of the actual vacuum degree along the drainage strip, and also the plastic drainage strip, sand cushion, and geomembrane are all consumables with high costs.

SUMMARY OF THE INVENTION

The technical problem to be solved by the present invention is to provide, with respect to the above existing problems, a device for soft soil foundation treatment by means of vacuum-membrane-free vacuum preloading, so as to solve urging problems of soft soil foundation treatment, such as quality control, efficiency and effects and investment costs.

The technical solution adopted by the invention is: a device for soft soil foundation treatment by means of vacuum-membrane-free vacuum preloading, characterized by having several top plates laying on the surface of soft soil foundation and several vertical plates for being vertically driven into the soft soil foundation, wherein the vertical plates are driven against the symmetrical side edges of the top plates;

the vertical plate has an inner chamber, the top surface of the vertical plate is provided with a vertical plate main-hole in communication with the inner chamber of the vertical plate, both sides of the vertical plate are provided with several vertical plate vacuum mini-holes in communication with the inner chamber of the vertical plate; the vertical plate main-hole is in communication with vacuum equipment.

The top plate has an inner chamber, the top surface of the top plate is provided with a top plate main-hole in communication with the inner chamber of the top plate, the bottom surface of the top plate is provided with several top plate vacuum mini-holes in communication with the inner chamber of the top plate; the top plate main-hole is in communication with the vacuum equipment or pressurizing device.

The diameter of the vertical plate vacuum mini-holes is 0.001 to 2 mm; when the diameter of the vertical plate vacuum mini-holes is greater than 0.01 mm, non-woven filter cloth covering the vertical plate vacuum mini-holes is adhered externally onto both sides of the vertical plate.

On both sides of the vertical plate are side thin-plates having a thickness of 5 to 10 mm, and the periphery of the two side thin-plates of the vertical plate is sealed by a vertical plate sealing plate and a chamber is formed between the two side thin-plates; the two side thin-plates of the vertical plate are welded and connected by several steel strips.

The diameter of the top plate vacuum mini-holes is 0.001 to 2 mm; when the diameter of the top plate vacuum mini-holes is greater than 0.01 mm, a non-woven filter cloth covering the top plate vacuum mini-holes is adhered externally on the bottom surface of the top plate.

The top and bottom surfaces of the top plate are top and bottom thin-plates having a thickness of 10 to 20 mm, the periphery of the top and bottom thin-plates of the top plate is sealed by the top plate sealing plate and a chamber is formed between the top and bottom thin-plates; the top and bottom thin-plates of the top plate are welded and connected by means of several steel strips.

The top plates and the vertical plates are welded and connected by means of steel bars, and the gaps between the top plates and the vertical plates are sealed with a sealing material.

The degree of consolidation of the soil between the two vertical plates on both sides of the top plate is calculated as follows:

$$\overline{U}_t = 1 - \alpha e^{-\beta t}$$

where, $\overline{U}_t$ is the average degree of consolidation within the depth range of the soft soil foundation treatment;

$$\alpha = \frac{8}{\pi^2};\ \beta = \frac{\pi^2 c_h}{D^2};$$

D is the spacing between vertical plates (2); $c_h$ is the horizontal consolidation coefficient of the soft soil foundation.

There is provided a treatment method of the device for soft soil foundation treatment by means of vacuum-membrane-free vacuum preloading, characterized by:

laying several said top plates on the surface of soft soil foundation, and leaving a gap with a width adapted to the thickness of the vertical plate between top plates;

driving the vertical plates against the symmetrical side edges of the top plate vertically into the soft soil foundation to a designed depth;

communicating vacuum equipment with the vertical plates;

turning on the vacuum equipment to perform vacuum preloading treatment of the soft soil foundation.

There is provided a treatment method of the device for soft soil foundation treatment by means of vacuum-membrane-free vacuum preloading, characterized by:

laying several said top plates on the surface of soft soil foundation, and leaving a gap with a width adapted to the thickness of the vertical plate between top plates;

driving the vertical plates against the symmetrical side edges of the top plate vertically into the soft soil foundation to a designed depth;

connecting and fixing the top plates and the vertical plates by means of steel bars, sealing the gaps between the top plates and the vertical plates with a sealing material;

communicating vacuum equipment with the vertical plates, communicating pressurizing device with the top plates;

turning on the vacuum equipment and the pressurizing device to perform vacuum combined pressurization of the soft soil foundation.

The present invention has the following beneficial effects: the new reusable device for soft soil foundation treatment by means of vacuum-membrane-free vacuum preloading according to the present invention, combined and formed by vertical plates having vacuum mini-holes and top plates, is inserted into soft soil foundation, and when connected with traditional vacuum equipment, can perform vacuum preloading treatment of the soft soil foundation, achieving the effect of accelerating the fast drainage and consolidation of the soft soil foundation. In the present invention, after the top plates are connected with the pressurizing device and the vertical plates are connected with the vacuum equipment, vacuum combined pressurization treatment can be performed on the soft soil foundation. The device can be recyclable, reusable and easy to use, can reduce costs, and ensure quality, improve efficiency and effectiveness. The promotion and application of the device will produce good economic and social benefits.

DETAILED DESCRIPTION OF THE EMBODIMENTS

Figure 1:
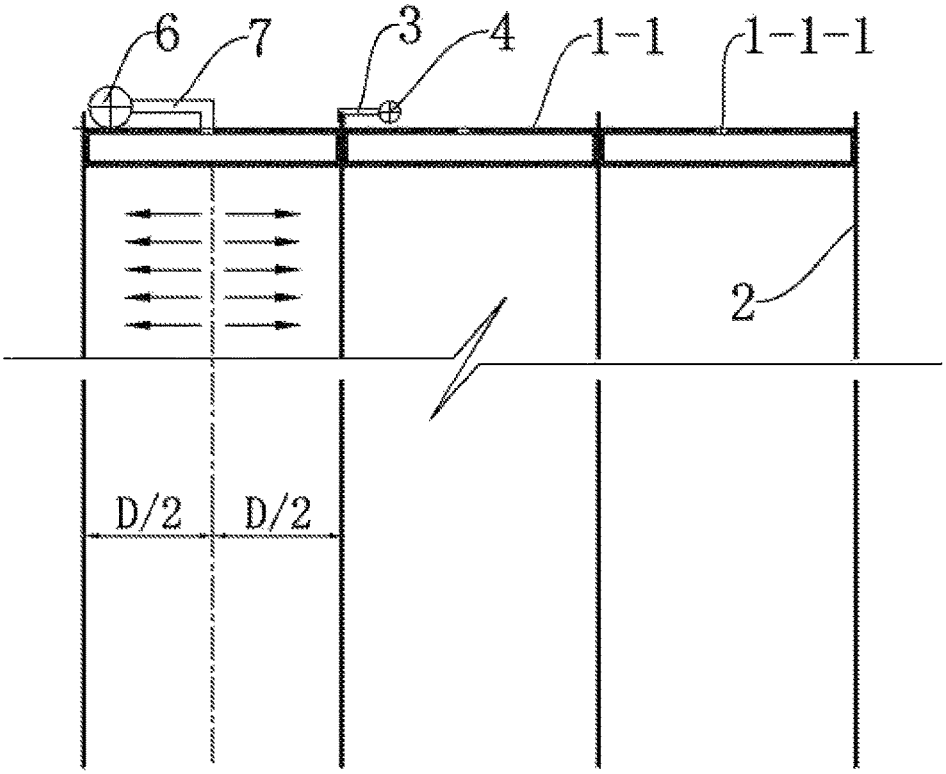
FIG. 1 is a schematic structural view of an embodiment.
Figure 2:
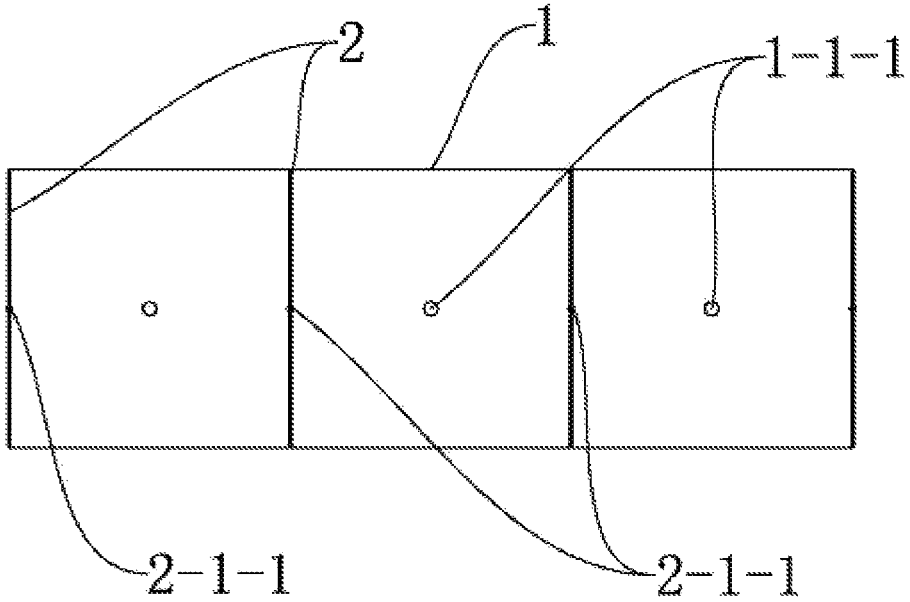
FIG. 2 is a top view of the embodiment.

As shown in FIG. 1 and FIG. 2, the present embodiment is a device for soft soil foundation treatment by means of vacuum-membrane-free vacuum preloading, having several top plates 1 for being laid on the surface of soft soil foundation and several vertical plates 2 for being vertically driven into the soft soil foundation, wherein the vertical plates 2 are driven against the symmetrical side edges of the top plates 1.

Figure 3:
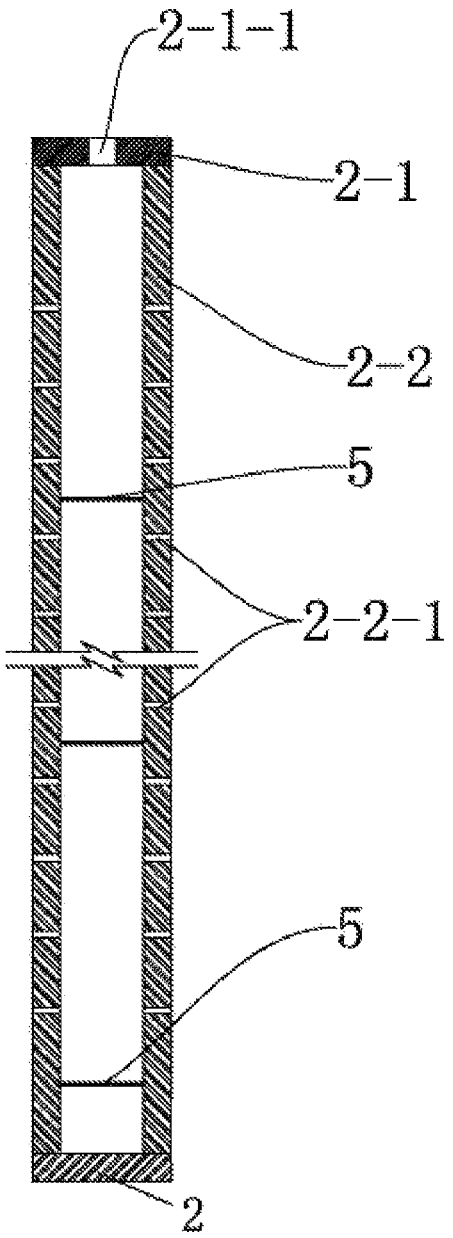
FIG. 3 is a sectional view of a vertical plate in the embodiment.

As shown in FIG. 3, in the present embodiment, on the left and right sides of the vertical plate 2 are side thin-plates 2-2 having a thickness of 5 to 10 mm, and the periphery of the two side thin-plates 2-2 of the vertical plate is sealed by a vertical plate sealing plate 2-1 having a thickness of 10 to 20 mm, thereby forming a chamber between the two side thin-plates 2-2. The two side thin-plates 2-2 are welded and connected by means of several steel strips 5, and the steel strips 5 are arranged in a square grid shape.

In this example, the two side thin-plates 2-2 of the vertical plate 2 are provided evenly with several vertical plate vacuum mini-holes 2-2-1 communicating the inner chamber of the vertical plate 2 with the outside of the vertical plate 2, and the diameter of the vertical plate vacuum mini-holes 2-2-1 is 0.001 to 2 mm. When the diameter of the vertical plate vacuum mini-holes 2-2-1 is greater than 0.01 mm, non-woven filter cloth covering the vertical plate vacuum mini-holes 2-2-1 is adhered externally to the side thin-plates 2-2. The vertical plate sealing plate 2-1 at the top of the vertical plate 2 is provided with a vertical plate main-hole 2-1-1 in communication with the inner chamber of the vertical plate 2, and the diameter of the vertical plate main-hole 2-1-1 is 20 to 30 mm.

Figure 4:
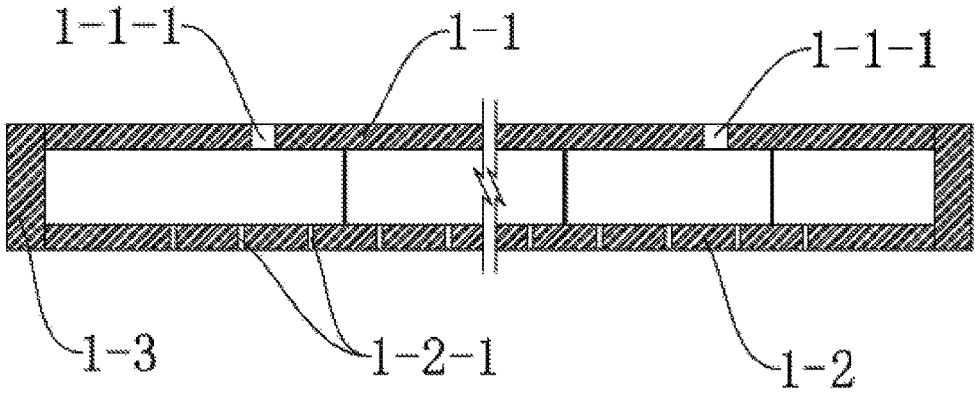
FIG. 4 is a sectional view of a top plate in the embodiment.

As shown in FIG. 4, the top surfaces and bottom surfaces of the top plate 1 are a top thin-plate 1-1 and a bottom thin-plate 1-2 having a thickness of 10 to 20 mm, the periphery of the top thin-plate 1-1 and the bottom thin-plate 1-2 of the top plate is sealed by the top plate sealing plate 1-3 having a thickness of 10 to 20 mm, thereby forming a chamber between the top thin-plate 1-1 and the bottom thin-plate 1-2. The top thin-plate 1-1 and the bottom thin-plate 1-2 are welded and connected by means of several steel strips 5, and the steel strips 5 are arranged in a square grid shape.

The bottom thin-plate 1-2 of the top plate 1 is provided evenly with several top plate vacuum mini-holes 1-2-1 communicating the inner chamber of the top plate 1 with the outside of the top plate 1, and the diameter of the vertical plate vacuum mini-holes 2-2-1 is 0.001 to 2 mm. When the diameter of the vertical plate vacuum mini-holes 2-2-1 is greater than 0.01 mm, non-woven filter cloth covering the vertical plate vacuum mini-holes 2-2-1 is adhered externally to the side thin-plate 2-2. The top thin-plate 1-1 of the top plate 1 is provided with a top plate main-hole 1-1-1 in communication with the inner chamber of the top plate 1, and the diameter of the top plate main plate 1-1-1 is 30 to 50 mm.

In this embodiment, the vertical plate 2 is in communication with vacuum equipment, and the vacuum equipment includes a vacuum pump 3 and a vacuum tube 4, one end of the vacuum tube 4 being in communication with the vertical plate main-hole 2-1-1, the other end of the vacuum tube 4 being in communication with the vacuum pump 3.

The vacuum preloading treatment method in the present embodiment is as follows:

laying several said top plates 1 on the surface of soft soil foundation, and leaving a gap with a width adapted to the thickness of the vertical plate between top plates 1;

driving the vertical plates 2 against the symmetrical side edges of the top plate 1 vertically into the soft soil foundation to a designed depth;

communicating vacuum equipment with the vertical plates 2;

turning on the vacuum equipment to perform vacuum preloading treatment of the soft soil foundation.

A vacuum pump 3 is turned on to keep the vacuum pressure above 90 kPa, and the settlement of the top plates 1 is measured, the degree of consolidation is estimated according to a standard method or the following formula, $\overline{U}_t=1-\alpha e^{-\beta t}$, and the vacuuming is stopped when the degree of consolidation satisfies design requirements.

Where, $\overline{U}_t$ is the average degree of consolidation within the depth range of the soft soil foundation treatment;

$$\alpha=\frac{8}{\pi^2};\ \beta=\frac{\pi^2 c_h}{D^2};$$

D is the spacing between the vertical plates 2; $c_h$ is the horizontal consolidation coefficient of the soft soil foundation.

When the vacuum combined pressurization treatment is adopted, the top plates 1 and the vertical plates 2 are welded and connected by means of steel bars to ensure that the top plates 1 do not lift when pressurization is performed; the gaps between the top plates 1 and the vertical plates 2 are sealed with a sealing material such as a sealant, to ensue that there is no water and air leakage when pressurization is performed. pressurizing device is in communication with the top plates 1, and the pressurizing device includes a pressure pump 6 and a pressure tube 7, one end of the pressure tube 7 being in communication with the top plate main-hole 1-1-1, the other end of the pressure tube 7 being in communication with the pressure pump 6. In this way, the soft soil foundation can be pressurized, and combined with vacuum, vacuum combined pressurization treatment of the soft soil foundation can be performed.

The vacuum combined pressurization treatment method of the present embodiment is as follows:

laying several top plates 1 on the surface of soft soil foundation, and leaving a gap with a width adapted to the thickness of the vertical plate between top plates 1;

driving the vertical plates 2 against the symmetrical side edges of the top plate 1 vertically into the soft soil foundation to a designed depth;

connecting and fixing the top plates 1 and the vertical plates 2 by means of steel bars, sealing the gaps between the top plates 1 and the vertical plates 2 with a sealing material;

communicating vacuum equipment with the vertical plates 2, communicating pressurizing device with the top plates 1;

turning on the vacuum equipment and the pressurizing device to perform vacuum combined pressurization of the soft soil foundation.

What is claimed is:

1. A device for soft soil foundation treatment by vacuum-membrane-free vacuum preloading, characterized by having a plurality of top plates (1) for being laid on the surface of soft soil foundation and a plurality of vertical plates (2) for being vertically driven into the soft soil foundation;

wherein the vertical plates (2) are driven against the symmetrical side edges of the top plates (1); the vertical plate (2) has an inner chamber, the top surface of the vertical plate is provided with a vertical plate main-hole (2-1-1) in communication with the inner chamber of the vertical plate, both sides of the vertical plate (2) are provided with several vertical plate vacuum mini-holes (2-2-1) in communication with the inner chamber of the vertical plate; and the vertical plate main-hole (2-1-1) is in communication with vacuum equipment.

2. The device for soft soil foundation treatment by vacuum-membrane-free vacuum preloading according to claim 1, characterized in that, the top plate (1) has an inner chamber, the top surface of the top plate is provided with a top plate main-hole (1-1-1) in communication with the inner chamber of the top plate, the bottom surface of the top plate (1) is provided with several top plate vacuum mini-holes (1-2-1) in communication with the inner chamber of the top plate (1); the top plate main-hole (1-1-1) is in communication with the vacuum equipment or pressurizing device.

3. The device for soft soil foundation treatment by vacuum-membrane-free vacuum preloading according to claim 1, characterized in that, the diameter of the vertical plate vacuum mini-holes (2-2-1) is 0.001 to 2 mm; when the diameter of the vertical plate vacuum mini-holes (2-2-1) is greater than 0.01 mm, non-woven filter cloth covering the vertical plate vacuum mini-holes (2-2-1) is adhered externally onto both sides of the vertical plate (2).

4. The device for soft soil foundation treatment by vacuum-membrane-free vacuum preloading according to claim 3, characterized in that, on both sides of the vertical plate (2) are side thin-plates (2-2) having a thickness of 5 mm to 10 mm, the periphery of the two side thin-plates (2-2) of the vertical plate is sealed by a vertical plate sealing plate (2-1) and a chamber is formed between the two side thin-plates (2-2); the two side thin-plates (2-2) of the vertical plate (2) are welded and connected by means of several steel strips (5).

5. The device for soft soil foundation treatment by vacuum-membrane-free vacuum preloading according to claim 2, characterized in that, the diameter of the top plate vacuum mini-holes (1-2-1) is 0.001 to 2 mm; when the diameter of the top plate vacuum mini-holes (1-2-1) is greater than 0.01 mm, a non-woven filter cloth covering the top plate vacuum mini-holes (1-2-1) is adhered externally on the bottom surface of the top plate (1).

6. The device for soft soil foundation treatment by vacuum-membrane-free vacuum preloading according to claim 5, characterized in that, the top and bottom surfaces of the top plate (1) are a top thin-plate (1-1) and a bottom thin-plate (1-2) having a thickness of 10 to 20 mm, the periphery of the top thin-plate (1-1) and the bottom thin-plate (1-2) of the top plate is sealed by a top plate sealing plate (1-3) and a chamber is formed between the top thin-plate (1-1) and the bottom thin-plate (1-2); the top thin-plate (1-1) and the bottom thin-plate (1-2) of the top plate are welded and connected by means of several steel strips (5).

7. The device for soft soil foundation treatment by vacuum-membrane-free vacuum preloading according to claim 1, characterized in that, the top plates (1) and the vertical plates (2) are welded and connected by means of steel bars, and the gaps between the top plates (1) and the vertical plates (2) are sealed with a sealing material.

8. The device for soft soil foundation treatment by vacuum-membrane-free vacuum preloading according to claim 1, characterized in that, the degree of consolidation of the soil between the two vertical plates (2) on both sides of the top plate (1) is calculated as follows:

$$\overline{U}_t = 1 - \alpha e^{-\beta t}$$

where, $\overline{U}_t$ is the average degree of consolidation within the depth range of the soft soil foundation treatment;

$$\alpha = \frac{8}{\pi^2};\ \beta = \frac{\pi^2 c_h}{D^2};$$

D is the spacing between vertical plates (2); $c_h$ is the horizontal consolidation coefficient of the soft soil foundation.

9. A treatment method of the device for soft soil foundation treatment by vacuum-membrane-free vacuum preloading according to claim 1, characterized by:

laying several said top plates (1) on the surface of soft soil foundation, and leaving a gap with a width adapted to the thickness of the vertical plate between top plates (1);

driving the vertical plates (2) against the symmetrical side edges of the top plate (1) vertically into the soft soil foundation to a designed depth;

communicating vacuum equipment with the vertical plates (2);

turning on the vacuum equipment to perform vacuum preloading treatment of the soft soil foundation.

10. A treatment method of the device for soft soil foundation treatment by vacuum-membrane-free vacuum preloading according to claim 1, characterized by:

laying several said top plates (1) on the surface of soft soil foundation, and leaving a gap with a width adapted to the thickness of the vertical plate (2) between top plates (1);

driving the vertical plates (2) against the symmetrical side edges of the top plate (1) vertically into the soft soil foundation to a designed depth;

connecting and fixing the top plates (1) and the vertical plates (2) by means of steel bars, sealing the gaps between the top plates (1) and the vertical plates (2) with a sealing material;

communicating vacuum equipment with the vertical plates (2), communicating pressurizing device with the top plates (1);

turning on the vacuum equipment and the pressurizing device to perform vacuum combined pressurization of the soft soil foundation.

* * * * *